US005964406A

United States Patent [19]

Zuo

[11] Patent Number: 5,964,406

[45] Date of Patent: Oct. 12, 1999

[54] VALVE AREA SCHEDULING IN A DOUBLE ACTING PISTON FOR A HYDRAULICALLY-ACTUATED FUEL INJECTOR

[75] Inventor: Lianghe Zuo, Chicago, Ill.

[73] Assignee: Caterpillar Inc., Peoria, Ill.

[21] Appl. No.: 09/086,083

[22] Filed: May 28, 1998

[51] Int. Cl.[6] ..... F02M 47/02

[52] U.S. Cl. ..... 239/88; 239/5; 239/96; 251/129.1; 137/625.65; 137/625.68; 91/464

[58] Field of Search ..... 239/88–92, 96, 239/5, 124; 251/129.1; 137/625.65, 625.68; 91/464

[56] References Cited

U.S. PATENT DOCUMENTS

| | | | |
|---|---|---|---|
| 4,687,136 | 8/1987 | Ozu et al. | 239/124 |
| 5,284,220 | 2/1994 | Shimizu et al. | 137/625.65 |
| 5,460,329 | 10/1995 | Sturman | 239/96 |
| 5,632,444 | 5/1997 | Camplin et al. | 239/88 |
| 5,640,987 | 6/1997 | Sturman | 137/625.65 |
| 5,671,715 | 9/1997 | Tsuzuki | 239/96 |

*Primary Examiner*—Andres Kashnikow
*Assistant Examiner*—Dinh Q. Nguyen
*Attorney, Agent, or Firm*—Michael B. McNeil

[57] ABSTRACT

A hydraulically-actuated fuel injector includes an injector body that defines a high pressure inlet, a low pressure drain, an upper actuation fluid cavity, a lower actuation fluid cavity, and a nozzle outlet. A piston is positioned in the injector body and moveable between a retracted position and an advanced position. A control valve is attached in the injector body and includes a spool valve member that is moveable between a first position and a second position. When the spool valve member is in its first position, the piston is biased toward its retracted position since the upper actuation fluid cavity is open to the low pressure drain, but the lower actuation fluid cavity is open to the high pressure inlet. During an injection event, the spool valve member is moved to its second position where the upper actuation fluid cavity is open to the high pressure inlet, but the lower actuation fluid cavity is open to the low pressure drain. At the end of an injection event, the spool valve member is moved through an intermediate position in which both the upper and lower actuation fluid cavities are exposed to the high pressure inlet. This causes the piston to abruptly cease its downward pumping stroke, resulting in a quicker drop in fuel pressure, a faster closure of the needle check valve, and hence a more abrupt end to the injection event.

20 Claims, 3 Drawing Sheets

VALVE AREA SCHEDULING IN A DOUBLE ACTING PISTON FOR A HYDRAULICALLY-ACTUATED FUEL INJECTOR

TECHNICAL FIELD

The present invention relates generally to hydraulically-actuated fuel injectors, and more particularly to control valve area scheduling in a double acting piston for a hydraulically-actuated fuel injector.

BACKGROUND ART

In one class of hydraulically-actuated fuel injectors, such as the type described in U.S. Pat. No. 5,460,329 to Sturman, an intensifier piston is hydraulically driven downward during an injection event by high pressure fluid acting on its top surface, and is retracted between injection events by high pressure actuation fluid acting on the underside of the piston. The piston may be driven using any suitable pressurized actuation fluid including possibly fuel fluid, but preferably uses pressurized engine lubricating oil. The piston is attached to move a relatively small diameter plunger that pressurizes fuel in a pump chamber. Because the area ratio of the piston to the plunger is often on the order of about 10 to 1, the fuel under the plunger can be raised to injection pressures that are about ten times as high as the actuation fluid pressure acting on the intensifier piston.

Engineers have come to recognize that undesirable engine noise and emissions can be improved over most portions of an engine's operating range when each injection event ends as abruptly as possible. Thus, there is a motivation to close the needle valve member that controls the nozzle outlet of the fuel injector as quickly as possible at the end of an injection event. In most instances, the needle valve member operates as a simple check valve, in that it is biased to a closed position with a spring but may be hydraulically lifted to an open position when fuel pressure is above some threshold capable of overcoming the biasing spring. In order to close such a needle valve as quickly as possible, it is necessary for fuel pressure to drop as quickly as possible at the end of an injection event so that the needle can move to close the nozzle outlet under the action of its biasing spring as quickly as possible without resistance from residual fuel pressure. Fuel pressure can be quickly dropped by abruptly ceasing the downward movement of the plunger and piston at the end of an injection event. Due at least in part to finite constraints relating to the electronic control valve that controls the flow of high pressure actuation fluid to the piston, there remains room for improving the performance of the Sturman fuel injector.

The present invention is directed to these and other problems associated with improving the performance of hydraulically-actuated fuel injectors having double acting intensifier pistons.

DISCLOSURE OF THE INVENTION

In one embodiment, a hydraulically-actuated fuel injector includes an injector body that defines an actuation fluid inlet, an actuation fluid drain, a first actuation fluid cavity, a second actuation fluid cavity and a nozzle outlet. A piston is positioned in the injector body and moveable between a retracted position and an advanced position. The piston has a primary hydraulic surface exposed to fluid in the first actuation fluid cavity, and an opposing hydraulic surface exposed to fluid in the second actuation fluid cavity. A control valve includes a spool valve member that is moveable between a first position and a second position. The first actuation fluid cavity is open to the actuation fluid drain, and the second actuation fluid cavity is open to the actuation fluid inlet, when the spool valve member is in its first position. The first actuation fluid cavity and the second actuation fluid cavity are open to the actuation fluid inlet when the spool valve member is in an intermediate position between its first and second positions. The first actuation fluid cavity is open to the actuation fluid inlet, and the second actuation fluid cavity is open to the actuation fluid drain, when the spool valve member is in its second position.

In another embodiment, a method of injecting fuel includes providing a hydraulically-actuated fuel injector with an actuation fluid inlet, a spool valve member, and a piston having a primary hydraulic surface exposed to fluid in a first actuation fluid cavity and an opposing hydraulic surface exposed to fluid in a second actuation fluid cavity. The spool valve member is stopped at a first position in which the first actuation fluid cavity is closed, but the second actuation fluid cavity is open, to the actuation fluid inlet. The spool valve member is moved through an intermediate position in which both the first actuation fluid cavity and the second actuation fluid cavity are open to the actuation fluid inlet. The spool valve member is then stopped at a second position in which the first actuation fluid cavity is open, but the second actuation fluid cavity is closed, to the actuation fluid inlet. Finally, the spool valve member is moved back through the intermediate position.

BEST MODE FOR CARRYING OUT THE INVENTION

Figure 1:
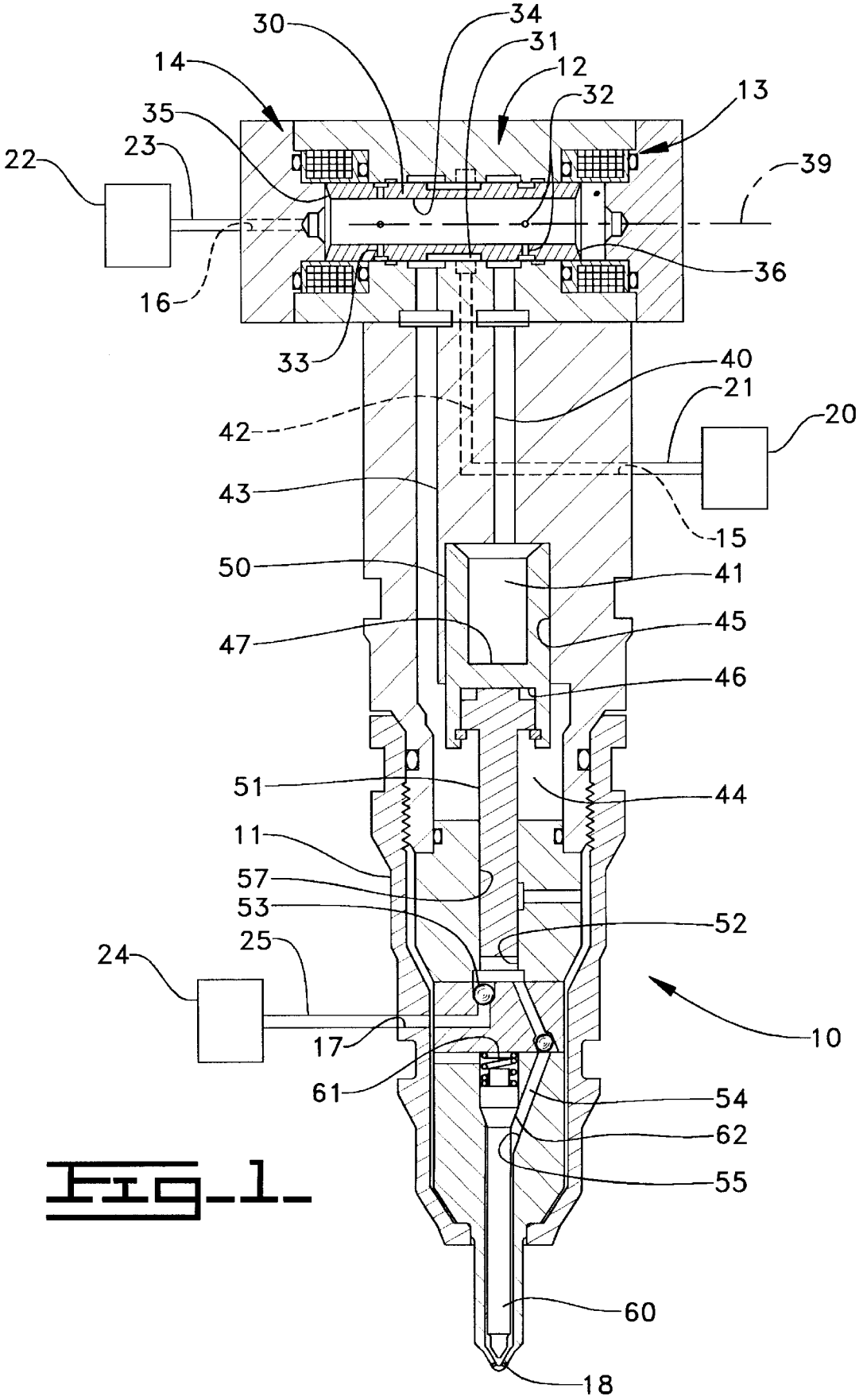
FIG. 1 is a front sectioned diagrammatic view of a hydraulically-actuated fuel injector according to the present invention.

Referring now to FIG. 1, a hydraulically-actuated fuel injector 10 includes various components, except for its control valve, that are substantially identical to the fuel injector components described in U.S. Pat. No. 5,460,329 to Sturman. Nevertheless, a brief review of several of these key components will be useful in understanding how the present invention works. Fuel injector 10 includes an injector body 11 made up of various components attached to one another in a manner well known in the art. A control valve 12 is attached to injector body 11 and includes a first solenoid 13 and a second opposing solenoid 14. Injector body 11 defines an actuation fluid inlet 15 that is connected to a source of pressurized actuation fluid 20 via an actuation fluid supply passage 21. After performing work within fuel injector 10, actuation fluid leaves injector body 11 at a low pressure actuation fluid drain 16 and travels to a drain reservoir 22, such as an engine oil sump, via a drain passage 23. Injector body 11 also defines a fuel inlet 17 that is connected to a source of relatively low pressure fuel fluid 24 via a fuel supply passage 25. During an injection event, fuel leaves injector 10 via a nozzle outlet 18 that is appropriately positioned in a combustion space within an internal combustion engine.

Injector body 11 defines an internal piston bore 45 within which an intensifier piston 50 moves between a retracted position, as shown, and a downward advanced position. Piston 50 includes a primary hydraulic surface 47 exposed to fluid pressure in a first actuation fluid cavity 41, and an opposing hydraulic surface 46 that is exposed to fluid pressure in a second actuation fluid cavity 44. A primary fluid supply passage 40 extends between control valve 12 and first actuation fluid cavity 41, and an opposing fluid supply passage 43 extends between control valve 12 and second actuation fluid cavity 44. A high pressure supply passage 42 extends between actuation fluid inlet 15 and control valve 12. Primary fluid supply passage 40 and opposing fluid supply passage 43 are positioned on opposite sides of high pressure supply passage 42 along centerline 39.

Control valve 12 includes a spool valve member 30 that moves along a centerline 39 between a first position, as shown, and a rightward second position. Spool valve member 30 includes a hollow interior 34 that is always open to actuation fluid drain 16, and an outer annulus 31 that is always open to high pressure fluid supply passage 42. Spool valve member 30 includes a plurality of left-hand radial drain passages 33 and a plurality of right-hand radial drain passages 32 that extend between hollow interior 34 and the outer surface of spool valve member 30. Spool valve member 30 includes a first end 35 and a second end 36 that are preferably equal in surface area to render spool valve member hydraulically balanced and always exposed to the low pressure of actuation fluid drain 16. Spool valve member 30 is coupled to first solenoid 13 and second solenoid 14, such that it can be pulled selectively to either its first position or its rightward second position by selectively energizing and de-energizing an appropriate solenoid. Preferably, only one solenoid is energized at any time. Although the solenoids are preferably equal in strength, it might be desirable to have different strength solenoids in some applications, such as to move the valve member at different rates. Because spool valve member 30 is hydraulically balanced, neither solenoid needs to be energized when spool valve member 30 is stopped at either its leftward first position or its rightward second position.

A plunger 51 is attached to move with piston 50 in a plunger bore 57 between a retracted position and an advanced position. A portion of plunger bore 57 and plunger 51 define a fuel pressurization chamber 52 that is connected to nozzle outlet 18 via nozzle supply passage 54 and nozzle chamber 55. A needle valve member 60 is positioned in nozzle chamber 55 and biased to a downward closed position that blocks nozzle outlet 18 by a needle biasing spring 61. When fuel pressure in nozzle chamber 55 is above a valve opening pressure acting on lifting hydraulic surface 62, needle valve member 60 will lift upward to an open position against the action of biasing spring 61 to allow fuel to spray out of nozzle outlet 18. Fuel pressurization chamber 52 is also connected to fuel inlet 17 past a check valve 53, which prevents the back flow of fuel into fuel supply passage 25 when plunger 51 is undergoing its downward pumping stroke.

INDUSTRIAL APPLICABILITY

Figure 2:
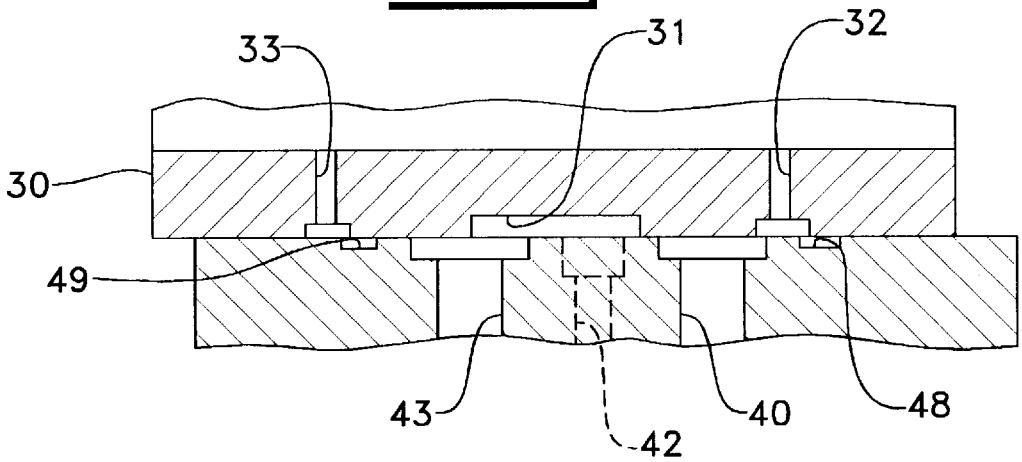
FIGS. 2–5 are a series of fragmented diagrammatic views showing the various positions of the control valve for the fuel injector of FIG. 1.
Figure 3:
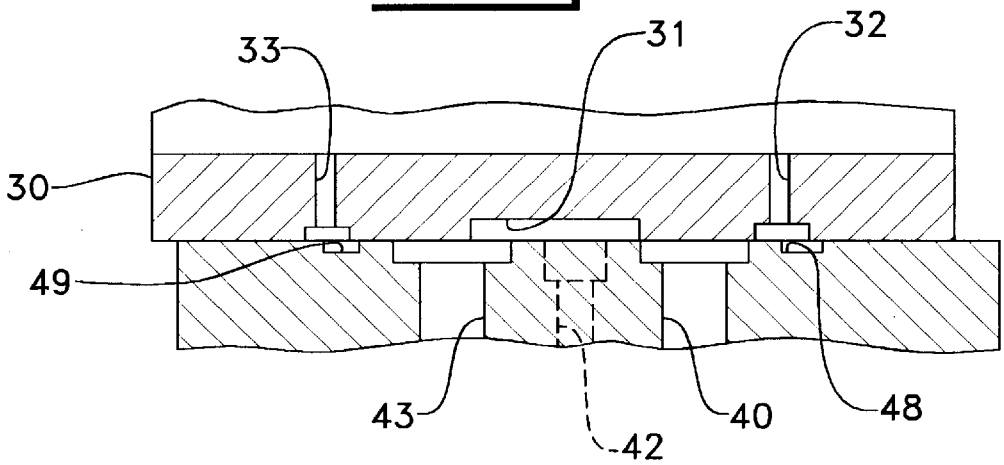
Figure 4:
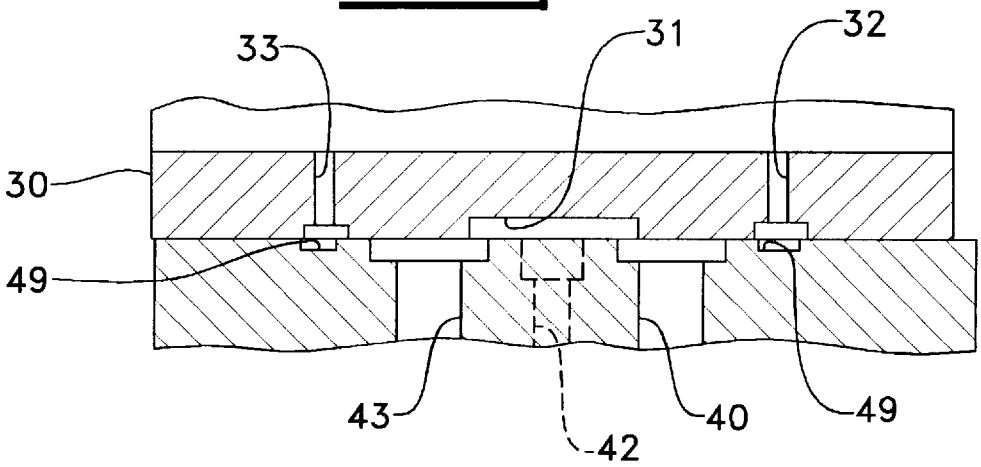

Referring now in addition to FIGS. 2–7, the operation of fuel injector 10 will be described in relation to the positioning of spool valve member 30 throughout an injection event. The spool valve member 30 of the present invention has been modified from the spool valve member described in the Sturman patent by slightly rearranging the various passageways and resizing annulus 31 so that it can simultaneously open primary fluid supply passage 40 and opposing fluid supply passage 43 to high pressure fluid supply passage 42 at an intermediate position as shown in FIG. 4.

Between injection events, spool valve member 30 is stopped at its leftward first position as shown in FIG. 2. When in this position, actuation fluid inlet 15 is connected to second actuation fluid cavity 44 via high pressure supply passage 42, annulus 31 and opposing fluid supply passage 43. Thus, opposing hydraulic surface 46 is exposed to high fluid pressure which tends to bias both piston 50 and plunger 51 upward toward their retracted positions, as shown. Piston 50 is allowed to retract because first actuation fluid cavity 41 is exposed to the low pressure of actuation fluid drain 16 via primary fluid supply passage 40, radial drain passages 32 and hollow interior 34 of spool valve member 30. This allows fluid in cavity 41 to be displaced into drain 16 when piston 50 retracts. The presence of drain annuluses 48 and 49 help to channel any high pressure leakage along the outside of spool valve member 30 into hollow interior 34 so that spool valve member 30 can be maintained hydraulically balanced. This allows solenoids 13 and 14 to be turned off when spool valve member is stopped in its first position as shown in FIG. 2 or its rightward second position as shown in FIG. 6.

Figure 5:
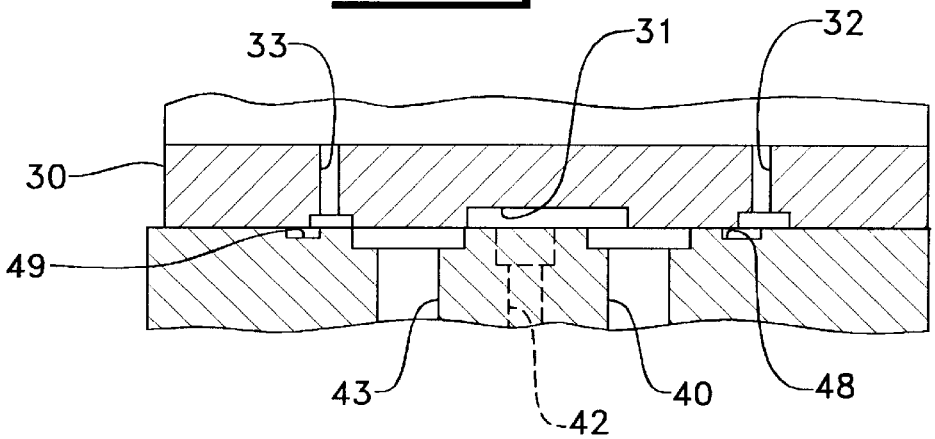

When it is time to initiate an injection event, solenoid 13 is energized to pull spool valve member 30 sequentially through a first intermediate position as shown in FIG. 3, a second intermediate position as shown in FIG. 4 and third intermediate position as shown in FIG. 5. When spool valve member reaches its rightward second position as shown in FIG. 6, solenoid 13 is de-energized and the spool valve member stays in place. In the first intermediate position as shown in FIG. 3, primary fluid supply passage 40 becomes closed to both radial drain passages 32 and annulus 31. In the second intermediate position as shown in FIG. 4, primary fluid supply passage 40 opens to the high pressure in annulus 31 so that both the primary hydraulic surface 47 and the opposing hydraulic surface 46 of piston 50 are now exposed to the high pressure of actuation fluid inlet 15. When a spool valve continues moving through the third intermediate position as shown in FIG. 5, opposing fluid supply passage 43 becomes closed to annulus 31 and is also closed to radial drain passages 33. The injection event begins when piston 50 and plunger 51 move downward sufficiently to pressurize fuel above a valve opening pressure. This generally cannot occur until spool valve member 30 reaches its second position as shown in FIG. 6 so that second actuation fluid cavity 44 is vented to the low pressure drain via radial drain passages 33, and primary hydraulic surface 47 is exposed to the high fluid pressure via annulus 31.

Figure 6:
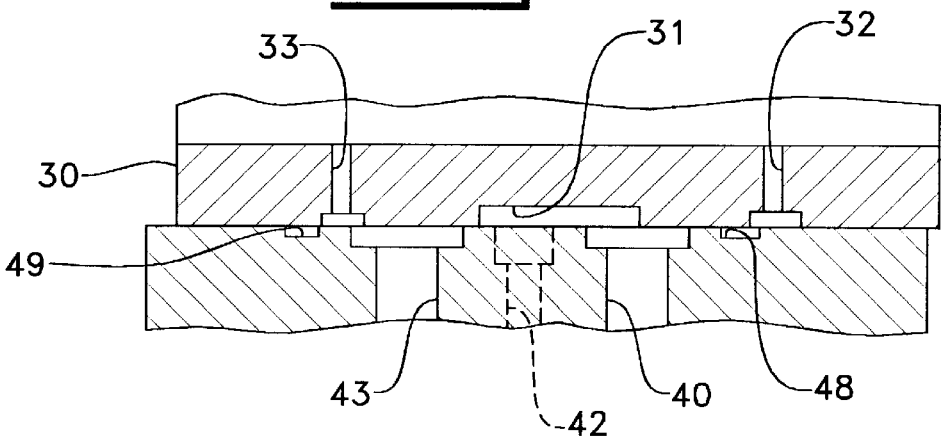
Figure 7:
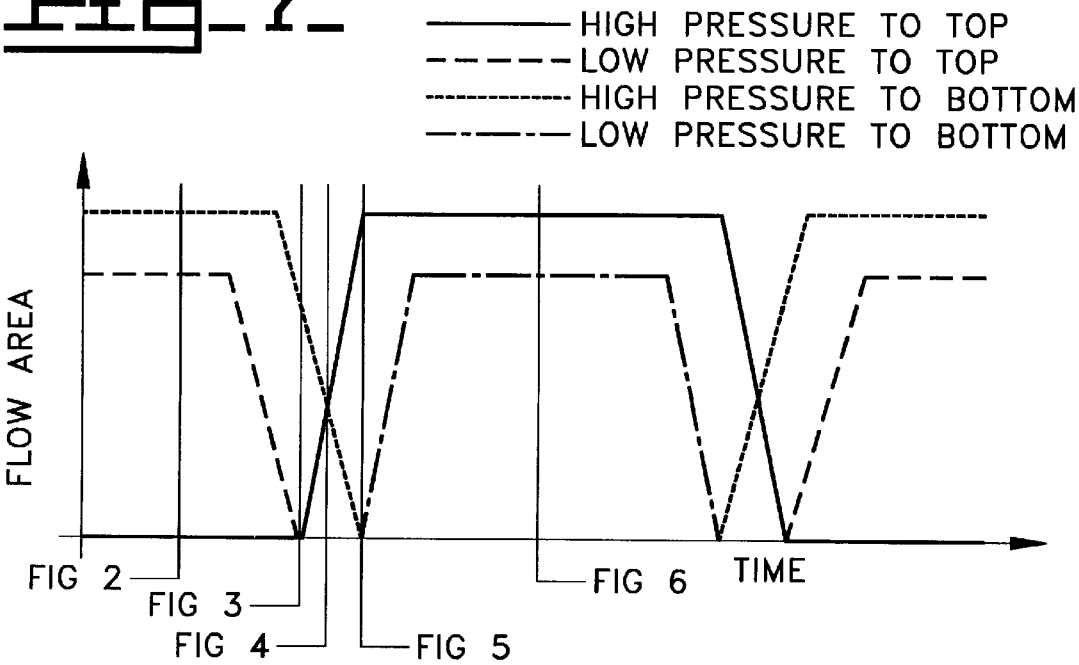
FIG. 7 is a graph of flow area to the piston versus time for the fuel injector shown in FIG. 1.

Unless a split injection is desired, spool valve member 30 will remain in its rightward second position as shown in FIG. 6 for the duration of the injection event. If a split injection is desired, solenoids 13 and 14 can be selectively energized to move spool valve member 30 leftward briefly and then back again rightward for a sufficient amount of time and for a sufficient distance for a split injection event to take place. Each injection event is ended by energizing solenoid 14 to pull spool valve member 30 leftward toward the first position shown in FIG. 2. In order to provide an abrupt end to the injection event, the present invention includes the second intermediate position as shown in FIG. 4. As spool valve member 30 is moving, it passes through this position which suddenly exposes the underside of piston 50 to the high pressure in annulus 31 while this high pressure continues acting on the upper primary hydraulic surface 47. This causes the piston and plunger to stop suddenly, which results in an abrupt drop in fuel pressure and a quicker closure of needle valve member 60. FIG. 7 graphically shows how the flow areas to piston 50 past spool valve member 30 change as control valve 12 proceeds through a typical injection event.

The present invention is capable of providing a more abrupt end to injection than that of the Sturman injector discussed earlier since the various passageways in spool valve member have been modified to include the intermediate position shown in FIG. 4. The Sturman control valve is believed capable of achieving the positions shown in FIGS. 2, 3, 5 and 6, but not the intermediate position shown in FIG. 4, which exposes both the primary and opposing hydraulic surfaces of the piston simultaneously to the high pressure actuation fluid inlet. This simultaneous exposure of both the primary and opposing hydraulic surface of piston 50 to the high pressure of actuation fluid quickly arrests the piston and plunger's downward momentum, which results in a quicker drop in fuel pressure and a more abrupt end to each injection event than that possible with the earlier Sturman fuel injector.

The above description is intended for illustrative purposes only, and is not intended to limit the scope of the invention in any way. For instance, while the invention has been illustrated using a control valve having two solenoids, those skilled in the art will appreciate that the present invention could also utilize a single solenoid and a spring biased spool valve member and still perform substantially the same way. In addition, the various passageways and annuluses could be relocated and resized in a way that retains the flow characteristics of the intermediate position shown in FIG. 4, without otherwise altering the performance of the fuel injector. Thus, various modifications could be made to the illustrated embodiment without departing from the spirit and intended scope of the present invention, which is defined in terms of the claims set forth below.

I claim:

1. A hydraulically actuated fuel injector comprising:

an injector body defining an actuation fluid inlet, an actuation fluid drain, a first actuation fluid cavity, a second actuation fluid cavity and a nozzle outlet;

a piston positioned in said injector body and being moveable between a retracted position and an advanced position, and said piston having a primary hydraulic surface exposed to fluid in said first actuation fluid cavity, and further having an opposing hydraulic surface exposed fluid in said second actuation fluid cavity;

a control valve that includes a spool valve member moveable between a first position and a second position;

said first actuation fluid cavity being open to said actuation fluid drain, and said second actuation fluid cavity being open to said actuation fluid inlet, when said spool valve member is in said first position;

said first actuation fluid cavity and said second actuation fluid cavity being open to said actuation fluid inlet when said spool valve member is in an intermediate position between said first position and said second position; and said first actuation fluid cavity being open to said actuation fluid inlet, and said second actuation fluid cavity being open to said actuation fluid drain, when said spool valve member is in said second position.

2. The hydraulically actuated fuel injector of claim 1 wherein said spool valve member defines an annulus that is always open to said actuation fluid inlet.

3. The hydraulically actuated fuel injector of claim 2 wherein said control valve includes a pair of opposing solenoids operably coupled to said spool valve member.

4. The hydraulically actuated fuel injector of claim 2 wherein said spool valve member is hydraulically balanced.

5. The hydraulically actuated fuel injector of claim 2 wherein said first actuation fluid cavity and said second actuation fluid cavity are open to said actuation fluid inlet via said annulus when said spool valve member is in said intermediate position.

6. The hydraulically actuated fuel injector of claim 2 wherein said first actuation fluid cavity and said second actuation fluid cavity are closed to said actuation fluid drain when said spool valve member is in said intermediate position.

7. The hydraulically actuated fuel injector of claim 2 wherein said spool valve member moves sequentially through a first intermediate position, a second intermediate position and a third intermediate position when moving from said first position to said second position;

said first actuation fluid cavity being closed to said actuation fluid inlet and said actuation fluid drain when said spool valve member is in said first intermediate position;

said first actuation fluid cavity and said second actuation fluid cavity being open to said actuation fluid inlet when said spool valve member is in said second intermediate position; and said second actuation fluid cavity being closed to said actuation fluid inlet and said actuation fluid drain when said spool valve member is in said third intermediate position.

8. The hydraulically actuated fuel injector of claim 2 wherein said spool valve member has a hollow interior that is always open to said actuation fluid drain.

9. A method of injecting fuel comprising the steps of:

providing a hydraulically actuated fuel injector with an actuation fluid inlet, a spool valve member, and a piston having a primary hydraulic surface exposed to fluid in a first actuation fluid cavity and an opposing hydraulic surface exposed fluid in a second actuation fluid cavity;

stopping said spool valve member at a first position in which said first actuation fluid cavity is closed, but said second actuation fluid cavity is open, to said actuation fluid inlet;

moving said spool valve member through an intermediate position in which said first actuation fluid cavity and said second actuation fluid cavity are open to said actuation fluid inlet; and stopping said spool valve member at a second position in which said first actuation fluid cavity is open, but said second actuation fluid cavity is closed, to said actuation fluid inlet; and moving said spool valve member back through said intermediate position.

10. The method of claim 9 wherein said fuel injector includes at least one solenoid operably coupled to said spool valve member; and said moving steps are accomplished by selectively energizing said at least one solenoid.

11. The method of claim 10 wherein said fuel injector includes an actuation fluid drain;

said first actuation fluid cavity being open to said actuation fluid drain when said spool valve member is in said first position; and said second actuation fluid cavity being open to said actuation fluid drain when said spool valve member is in said second position.

12. The method of claim 11 comprising the steps of moving said spool valve member sequentially through a first intermediate position, a second intermediate position and a third intermediate position when moving from said first position to said second position;

said first actuation fluid cavity being closed to said actuation fluid inlet and said actuation fluid drain when said spool valve member is in said first intermediate position;

said first actuation fluid cavity and said second actuation fluid cavity being open to said actuation fluid inlet when said spool valve member is in said second intermediate position; and said second actuation fluid cavity being closed to said actuation fluid inlet and said actuation fluid drain when said spool valve member is in said third intermediate position.

13. The method of claim 12 wherein said first actuation fluid cavity and said second actuation fluid cavity are closed to said actuation fluid drain when said spool valve member is in said second intermediate position.

14. A hydraulically actuated fuel injector comprising:

an injector body defining an actuation fluid inlet, an actuation fluid drain, a first actuation fluid cavity, a second actuation fluid cavity and a nozzle outlet;

a piston positioned in said injector body and being moveable between a retracted position and an advanced position, and said piston having a primary hydraulic surface exposed to fluid in said first actuation fluid cavity, and further having an opposing hydraulic surface exposed fluid in said second actuation fluid cavity;

a control valve that includes a spool valve member moveable between a first position and a second position, and spool valve member defining a hollow interior always open to said actuation fluid drain and an annulus always open to said actuation fluid inlet;

said first actuation fluid cavity being open to said actuation fluid drain, and said second actuation fluid cavity being open to said actuation fluid inlet, when said spool valve member is in said first position;

said first actuation fluid cavity and said second actuation fluid cavity being open to said actuation fluid inlet when said spool valve member is in an intermediate position between said first position and said second position; and said first actuation fluid cavity being open to said actuation fluid inlet, and said second actuation fluid cavity being open to said actuation fluid drain, when said spool valve member is in said second position.

15. The hydraulically actuated fuel injector of claim 14 wherein said control valve includes a pair of opposing solenoids operably coupled to said spool valve member.

16. The hydraulically actuated fuel injector of claim 15 wherein said spool valve member is hydraulically balanced.

17. The hydraulically actuated fuel injector of claim 16 wherein said first actuation fluid cavity and said second actuation fluid cavity are open to said actuation fluid inlet via said annulus when said spool valve member is in said intermediate position.

18. The hydraulically actuated fuel injector of claim 17 wherein said first actuation fluid cavity and said second actuation fluid cavity are closed to said actuation fluid drain when said spool valve member is in said intermediate position.

19. The hydraulically actuated fuel injector of claim 18 wherein said spool valve member moves sequentially through a first intermediate position, a second intermediate position and a third intermediate position when moving from said first position to said second position;

said first actuation fluid cavity being closed to said actuation fluid inlet and said actuation fluid drain when said spool valve member is in said first intermediate position;

said first actuation fluid cavity and said second actuation fluid cavity being open to said actuation fluid inlet when said spool valve member is in said second intermediate position; and said second actuation fluid cavity being closed to said actuation fluid inlet and said actuation fluid drain when said spool valve member is in said third intermediate position.

20. The hydraulically actuated fuel injector of claim 19 wherein said spool valve member defines a plurality of drain passages extending between an outer surface of said spool valve member and said hollow interior.

* * * * *